US010522317B2

(12) United States Patent
Hess et al.

(10) Patent No.: US 10,522,317 B2
(45) Date of Patent: Dec. 31, 2019

(54) X-RAY RADIATION GENERATOR

(71) Applicant: Smiths Heimann GmbH, Wiesbaden (DE)

(72) Inventors: Gregor Hess, Wiesbaden (DE); Kai Lenz, Wiesbaden (DE); Michael Hirt, Frankfurt (DE); Alexander Adam, Mainz (DE); Andreas Streyl, Seibersbach (DE)

(73) Assignee: SMITHS HEIMANN GMBH, Wiesbaden (DE)

( * ) Notice: Subject to any disclaimer, the term of this patent is extended or adjusted under 35 U.S.C. 154(b) by 246 days.

(21) Appl. No.: 15/522,909

(22) PCT Filed: Oct. 30, 2015

(86) PCT No.: PCT/EP2015/075271
§ 371 (c)(1),
(2) Date: Apr. 28, 2017

(87) PCT Pub. No.: WO2016/066810
PCT Pub. Date: May 6, 2016

(65) Prior Publication Data

US 2017/0338076 A1 Nov. 23, 2017

(30) Foreign Application Priority Data

Oct. 30, 2014 (DE) ..... 10 2014 222 164

(51) Int. Cl.
*H01J 35/12* (2006.01)

(52) U.S. Cl.
CPC ..... *H01J 35/12* (2013.01); *H01J 2235/1283* (2013.01); *H01J 2235/1295* (2013.01)

(58) Field of Classification Search
CPC ..... H01J 35/12; H01J 2235/1283; H01J 2235/1295

(Continued)

(56) References Cited

U.S. PATENT DOCUMENTS 6,807,059 B1 10/2004 Dale
2003/0056943 A1 3/2003 Dessiatoun et al.
(Continued)

FOREIGN PATENT DOCUMENTS

CN 202221659 U 5/2012
DE 1100057 B 2/1961
(Continued)

OTHER PUBLICATIONS

International Preliminary Report on Patentability dated May 2, 2017 for PCT/EP2015/075271.
(Continued)

*Primary Examiner* — Courtney D Thomas
(74) *Attorney, Agent, or Firm* — Kevin E. West; Advent, LLP

(57) ABSTRACT

An X-ray tube includes an anode that conducts a high voltage that can be greater than 120 kV, and in particular greater than 300 kV, and heats up during operation. The anode is connected in a thermally conductive way to a heat sink, which has a base body composed of a metal with a heat absorbing surface for coupling to the anode as a heat source and a heat dissipating surface that is enlarged by means of heat dissipating elements that are connected to the base body. The heat dissipating elements are composed of an electrically insulating material having a thermal conductivity on the same order of magnitude as that of the metal of the base body, and have a height (H) starting from the base body of the heat sink so that there is a sufficient insulation breakdown resistance relative to the surroundings of the X-ray tube.

19 Claims, 5 Drawing Sheets

(58) Field of Classification Search
USPC ..... 378/142, 199
See application file for complete search history.

(56) References Cited

U.S. PATENT DOCUMENTS

| | | | | |
|---|---|---|---|---|
| 2003/0221816 | A1* | 12/2003 | Ellsworth, Jr. ..... | H01L 23/367<br>165/80.3 |
| 2006/0191675 | A1 | 8/2006 | Fletcher et al. | |
| 2006/0251218 | A1* | 11/2006 | Tybinkowski ..... | A61B 6/032<br>378/199 |
| 2017/0094761 | A1* | 3/2017 | Miller ..... | H05G 1/025 |

FOREIGN PATENT DOCUMENTS

| | | | |
|---|---|---|---|
| DE | 139327 | A1 | 12/1979 |
| DE | 202007007568 | U1 | 9/2007 |
| DE | 202012010600 | U1 | 12/2012 |
| JP | 2009164038 | A | 7/2009 |
| WO | 2012031943 | A1 | 3/2012 |
| WO | 2013021794 | A1 | 2/2013 |

OTHER PUBLICATIONS

International Search Report dated Mar. 23, 2016 for Application No. PCT/EP2015/075271.

* cited by examiner

X-RAY RADIATION GENERATOR

In general, the present disclosure relates to an X-ray tube with an anode that conducts a high voltage that can be greater than 120 kV, and in particular greater than 300 kV, and heats up during operation. In particular, the present disclosure relates to an X-ray tube with a heat sink, which is suitable for cooling the high voltage-conducting anode in cases where space is limited.

BACKGROUND

X-ray tubes are known as an example of an X-ray radiation generator. To avoid voltage flashovers, it is necessary to insulate high voltage-conducting parts such as anodes from other parts in the vicinity by providing sufficient insulation.

For example, in order to increase insulation breakdown resistance, a housing of an X-ray tube may additionally have a sleeve built into it, which is composed of a dielectric material such as epoxy resin with quartz flour, ceramic, or PTFE, which essentially contains a bulb of the X-ray tube inserted therein and covers the X-ray tube radially relative to the housing. The additional dielectric material provides better electrical shielding or insulation of the anode of the tube from the surroundings. Alternatively, there are X-ray tubes in which the tubular housing of the tube is composed of a ceramic. The subassemblies for generating the X-ray radiation are contained in the housing. The anode of an X-ray tube heats up during operation; to avoid damage due to overheating, the heat is usually dissipated from the anode by means of a heat sink.

Heat sinks can be composed of a metal with high thermal conductivity such as aluminum or copper. In a heat sink composed of metal, in the part of the anode lying outside the housing of the X-ray tube, a minimum distance must be maintained between the heat sink and other components or housing parts connected to a reference potential (e.g. ground, GND, etc.) in order to prevent voltage flashovers. If the X-ray tube is to be operated with higher voltages, then this safety distance must be correspondingly increased. This can make it necessary to enlarge the outer housing of a system in which the X-ray tube is contained.

An insulation sleeve as mentioned above would impair the heat dissipation. Alternatively, it is possible to use a heat sink composed of a ceramic with good thermal conduction properties such as aluminum oxide or aluminum nitride. A heat sink composed of ceramic, however, is expensive to produce since special molds must be used. In addition, the metal of the anode—usually copper—has a higher thermal expansion coefficient than the externally mounted ceramic heat sink. This makes the heat transmission between the anode and the heat sink problematic: on the one hand, the heat sink should have the best possible heat conduction contact with the anode in order to achieve the highest possible heat transfer coefficient. On the other hand, the heat sink must be prevented from being damaged or even exploding due to the mechanical stress generated by the expansion of the anode when heated.

The design requirement "as compact as possible" is fundamental to many devices. The size of an X-ray radiation generator is limited at the lower end by the fact that certain components must be integrated into it and by the fact that the distances between the components that are contacted by a different electrical potential must be selected so that the breakdown resistance of the insulating mediums is not exceeded at any point.

SUMMARY

The present disclosure provides an X-ray tube, in particular a vacuum X-ray tube, with an anode that conducts a high voltage that can be greater than 120 kV, particularly greater than 300 kV in specific embodiments, and heats up during operation, in which the insulation breakdown resistance of the anode, which is operated with higher voltages, relative to the surroundings is improved.

The present disclosure provides that a base body of a heat sink, as an interface with the anode (e.g., a metal anode) that is to be cooled, is embodied of a metal that has a high thermal conductivity such as aluminum (Al) or copper (Cu) and in order to increase the surface area for heat transmission to the surroundings, the base body heat is provided with dissipating elements such as cooling pins and/or cooling fins made of a ceramic that has a good thermal conductivity, but is electrically insulating, for example aluminum nitride (AlN) or silicon carbide (SiC). By means of this special embodiment of the heat sink, it is possible to satisfy three requirements: (i) the component to which the heat sink is attached can be cooled by means of thermal radiation and primarily convection; (ii) the insulation distance relative to adjacent components that contact a different electrical potential is increased, e.g. in comparison to a conventional all-metal- or full-metal heat sink; and (iii) voltage problems that can be produced due to differing thermal expansion coefficients between the ceramic and the component to be cooled can be compensated for by means of the base body as a transition piece. Finally, the combination of inexpensive components and the additional function of electrical insulation can make the heat sink according to the present disclosure superior to heat sinks composed of aluminum or ceramic.

A first aspect of the present disclosure thus relates to an X-ray tube with a heat sink for the anode, which heat sink has a base body made of metal. The surface of the base body has a heat absorbing surface for coupling to the anode as a heat source and a heat dissipating surface for dissipating heat, particularly through thermal radiation and convection. In order to enlarge the heat dissipating surface, heat dissipating elements are connected to the base body and/or are inserted into the base body. The heat dissipating elements are composed of an electrically insulating material whose thermal conductivity coefficient is on the same order of magnitude as that of the metal of the base body.

The base body can be composed of a metal with good thermal conductivity properties. The base body may be composed of a metal or a metal alloy that has a thermal conductivity coefficient of at least 100 W/(m K), and in particular greater than 200 W/(m K). For example, suitable candidates for this metal are aluminum (Al), copper (Cu), silver (Ag), or an alloy of these metals.

The material of the electrically insulating heat dissipating elements may have a thermal conductivity coefficient of greater than 100 W/(m K). In this context, "electrically insulating" means that the material has a specific resistance of at least 1012 Ω*m/mm2 and more. The heat dissipating elements may be composed of a ceramic. For example, silicon carbide (SiC) or aluminum nitride (AlN) are suitable candidates for the ceramic.

Suitable combinations with regard to the material selection for the base body and the heat dissipating elements include, for example, copper/silicon carbide or aluminum/aluminum nitride.

The heat dissipating elements can, for example, be plate-shaped and/or pin-shaped and/or tubular. In other words, the heat dissipating elements may have at least one of the following forms: plates, pins, or tubes. Basically, other shapes can also be used, which are suitable for enlarging the heat dissipating surface area on the one hand and for fastening to the base body by means of a measure explained further below.

The base body may have a corresponding socket or recess for each heat dissipating element. Each socket or recess is dimensioned in accordance with the shape of a connecting section of a heat dissipating element to be inserted.

The heat dissipating elements, i.e. the connecting sections, can be connected to the base body by means of nonpositive, frictional engagement. For example, each connecting section can be fastened in the associated socket by means of a press fit or clamping. In order to be able to insert the ceramic heat dissipating element, which is produced so that it is oversized relative to the socket, into the socket in the metallic base body, it is possible to heat the base body. When the base body cools, a press-fit, so to speak, is then produced by the shrinking of the base body onto the connecting section of the heat dissipating element. Since ceramic is very good at absorbing compressive forces, this connection fits in well with the strength properties of the ceramic. By means of the press fit, compression forces are induced on the connecting section, which is situated inside the base body, so that the metal/ceramic connection can easily absorb the stresses produced by the pressing. In addition, the press fit achieves a particularly good heat transfer from the base body to the heat dissipating elements.

If the heat dissipating elements are pin-shaped or tubular at least in the region of the connecting section, then a first thread can be molded or machined into the connecting section. Correspondingly, the sockets in the base body are embodied in the form of holes with a second thread that corresponds to the first thread. The heat dissipating elements can then be connected to the base body by screwing each of the connecting sections into the respective socket. The thread also can increase the contact area and thus the thermal transmission area between the base body and the individual heat dissipating elements.

The heat dissipating elements can also be connected to the base body by being cast into it. In this case, the connecting sections and the sockets are dimensioned so that an interstice exists or is produced between the respective connecting section and the associated socket. This interstice becomes or is filled or cast with a casting compound in order to fasten the heat dissipating element in the socket. In this case, it is not absolutely necessary for the sockets in the base body and the connecting sections of the heat dissipating elements to have a cross-section that is matched to each other. It is only necessary for each respective socket to be dimensioned so that the associated connecting section can be inserted into it. The casting compound does not have to absorb powerful forces and only serves to durably position the respective heat dissipating element in the metallic base body.

The heat dissipating elements can also be integrally bonded to the base body, for example by being glued in place with an organic or inorganic adhesive.

For example, organic casting compounds or epoxy resin-based adhesives are suitable for filling in gaps between the ceramic/metal parts or for gluing ceramic/metal parts. For higher application temperatures, it is suitable to use inorganic-based casting compounds or adhesives that contain mineral fillers such as aluminum oxide (Al2O3), zirconium oxide (ZrO2), and/or magnesium oxide (MgO) and a binder phase composed of water glass, water-soluble aluminosilicates, and/or phosphates. Examples for thermally conductive adhesives that should be cited here include Soltabond SB2001, SB5102-4, or SB5314 made by the company Soltabond GmbH.

The heat dissipating elements can also be integrally joined to the base body by means of soldering. In this case, preferably, at least the connecting section of the heat dissipating element is metallized in order to enable a wetting of the material with the solder. Copper and aluminum oxide ceramic and a titanium-copper-silver-based solder should be cited here as an example of a metal-ceramic combination and a suitable solder.

Basically, the base body of the heat sink can be a CNC-produced metal part.

The base body of the heat sink for the anode can be tubular, in particular cylindrical. If the base body is essentially a cylinder, then it can be produced as a turned element. The heat absorbing surface is then comprised of an inner surface of a recess extending axially in the base body. The shape of the recess is adapted to the coupling with the anode as a heat source. The remaining surface of the base body is once again part of the heat dissipating surface in which the sockets for the heat dissipating elements are embodied. A heat dissipating element may be inserted into each of these sockets and fastened in a way that conducts heat well.

In a special embodiment of the heat sink, the recesses are provided in the form of slots or grooves extending axially in the outer surface of the base body. Heat dissipating elements in the form of plate-shaped ceramic elements are inserted into these recesses with form-fitting engagement, with nonpositive, frictional engagement, or in an integrally joined way.

A heat sink according to the present disclosure is suitable for use in an electrical device having a component that conducts a high voltage and heats up during operation; the heat sink is connected to this component in a thermally conductive way.

The X-ray tube has the anode as a component that conducts a high voltage and heats up during operation. A heat sink is connected to the anode in a thermally conductive way. The heat dissipating elements may have a height that starts from the base body of the heat sink. The height may be dimensioned so that when the high voltage and possibly an insulating medium surrounding the heat dissipating elements are taken into account, a predetermined sufficient insulation breakdown resistance vis-à-vis the surroundings is achieved and/or ensured.

In practice, the size of the X-ray tube is limited at the lower end by the fact that certain components must be integrated into it and by the fact that the distances between the components that are contacted by different electrical potential must be selected so that the breakdown resistance of the insulating medium provided between them is not exceeded. In this case, the component to be cooled is essentially the anode of the X-ray tube. In a particular embodiment, the base body of the heat sink serves as a transition piece between the anode that heats up during operation (as a heat-generating component) and the ceramic heat dissipating elements, which function as cooling fins.

Since the anode is usually rotationally symmetrical in the connecting region, the base body of the heat sink can be produced in a particularly simple way as a turned element.

In order to join the insulating elements to the base body, slots or grooves can be provided in the base body by means of a CNC machine. The slots or grooves are matched to the dimensions of the connecting sections of the heat dissipating elements in accordance with the selected joining technique. Ceramic plates are particularly well-suited for use as heat dissipating elements since they are available in the form of inexpensive, mass-production articles.

BRIEF DESCRIPTION OF THE DRAWINGS

Other advantages, features, and details of the present disclosure ensue from the following description, in which exemplary embodiments of the present disclosure are described in detail with reference to the drawings. The features mentioned in the claims and in the description can each be essential by themselves or in any combination with one another. Likewise, the features mentioned above and explained in greater detail below can be used by themselves or in any combination with one another. Parts or components that are functionally similar or identical are sometimes provided with the same reference numerals. The terms "left," "right," "above," and "below" used in the description of the exemplary embodiments refer to the drawings in a direction with normally legible figure number and normally legible reference numerals. The embodiments depicted and described are not to be taken as comprehensive and instead, have an exemplary character intended for explanation of the present disclosure. The detailed description is provided in order to inform the person skilled in the art; for this reason, known circuits, structures, and methods are not depicted or explained in detail in the description in order not to hamper comprehension of the present description.

DETAILED DESCRIPTION

Figure 1A:
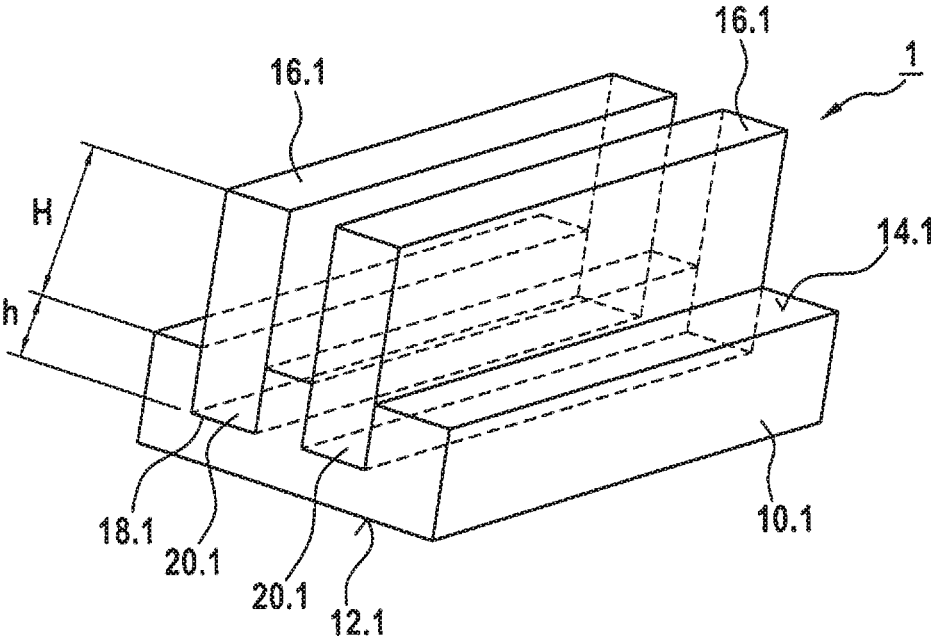
FIGS. 1*a* and 1*b* show a first exemplary embodiment of a heat sink.

The FIGS. 1*a* to 3*b* show three exemplary embodiments for heat sinks 1, 2, and 3, each having a base body 10.1, 10.2, 10.3 made of metal.

The base body has a respective heat absorbing surface 12.1, 12.2, 12.3 for coupling to a heat source. The heat source can be a component, which heats up or is heated during operation. During operation, heat is conveyed into the base body of the heat sink in a known way by means of thermal conduction. In other words, the heat absorbing surface essentially corresponds to the contact area with the heat source.

By means of thermal conduction, thermal radiation, and convection via its outer surfaces that are not in contact with the heat source, the base body 10.1, 10.2, 10.3 can, as a heat dissipating surface, dissipate the heat to an insulating medium (usually a fluid such as the ambient air in the simplest case) surrounding the heat dissipating surfaces. Essentially, the part of the outer surface of the base body 10.1, 10.2, 10.3, which is situated opposite from the heat absorbing surface 12.1, 12.2, 12.3, constitutes the heat dissipating surface 14.1, 14.2, 14.3 of the base body 10.1, 10.2, 10.3.

To enlarge the effective heat dissipating surface, heat dissipating elements 16.1, 16.2, 16.3, which are connected to the base body 10.1, 10.2, 10.3 in a thermally conductive way, are situated on the base body 10.1, 10.2, 10.3 in the region of the heat dissipating surface 14.1, 14.2, 14.3. The heat dissipating surface area 14.1, 14.2, 14.3 of the base body 10.1, 10.2, 10.3 is thus increased by the surface areas of the heat dissipating elements 16.1, 16.2, 16.3. The heat dissipating elements 16.1, 16.2, 16.3 are made of an electrically insulating material, which can have a thermal conductivity on the same order of magnitude as that of the metal of the base body 10.1, 10.2, 10.3. The respective connecting sections 20.1, 20.2, 20.3 of the heat dissipating elements 16.1, 16.2, 16.3 are inserted into correspondingly shaped sockets 18.1, 18.2, 18.3, which are molded into the base body 10.1, 10.2, 10.3 in a way that conducts heat into the base body 10.1, 10.2, 10.3.

Figure 1B:
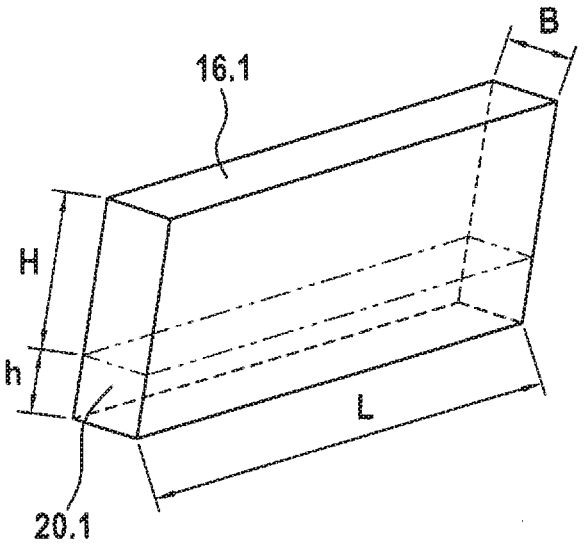

FIG. 1*a* shows the first exemplary embodiment of the heat sink 1 with plate-shaped heat dissipating elements 16.1. FIG. 1*b* shows one of the heat dissipating elements 16.1 from FIG. 1*a* by itself. The heat dissipating element 16.1 is embodied in the shape of a plate, i.e. it is plate-shaped.

The expression "plate-shaped" essentially means that the heat dissipating element 16.1 has significantly greater dimensions in length and height than it does in comparison to the width.

The plate-shaped heat dissipating element 16.1 has a width B and a height, which is composed of a height h of the connecting section 20.1 and the remaining length H with which the latter protrudes from the base body 10.1 after being inserted into it. The longitudinal span of the heat dissipating element 16.1 is labeled L. Since $B \ll L$ and $B \ll (h+H)$, the heat dissipating element is plate-shaped.

With the connecting section 20.1, the heat dissipating elements 16.1 are inserted into the recesses 18.1 provided or embodied in the base body 10.1 and are then fastened in it in a thermally conductive way by means of one of the measures discussed below.

Figure 2A:
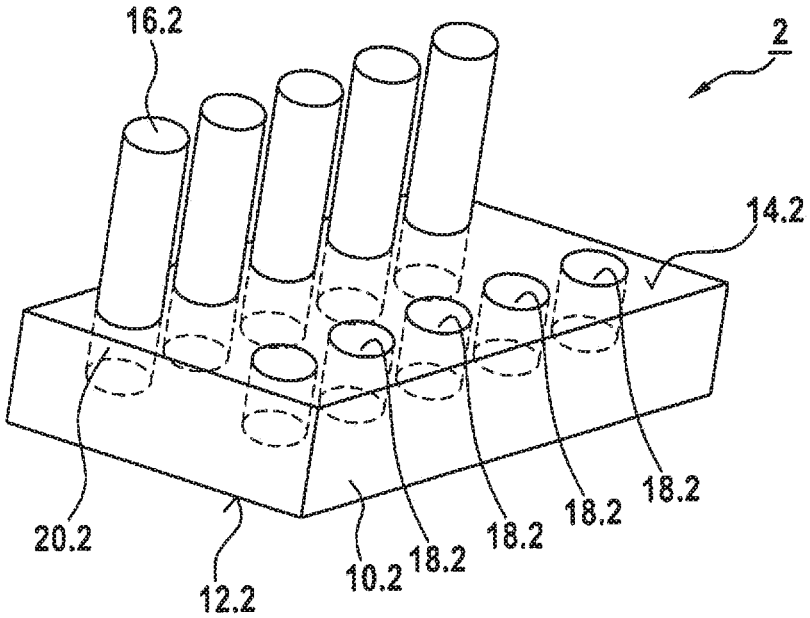
FIGS. 2*a* and 2*b* show a second exemplary embodiment of a heat sink.

FIG. 2*a* shows the second exemplary embodiment of the heat sink 2. In this case, the heat dissipating elements 16.2 are pins or rods, which are composed of an electrically insulating material and once again have a thermal conductivity on the same order of magnitude as that of the metal of the base body 10.2. Similar to what is shown in FIG. 1*a*, the pin-shaped or rod-shaped heat dissipating elements 16.2 are inserted with a respective connecting section 20.2 into recesses 18.2 correspondingly machined or molded into the base body 10.2 and are fastened therein with high thermal conductivity.

Figure 2B:
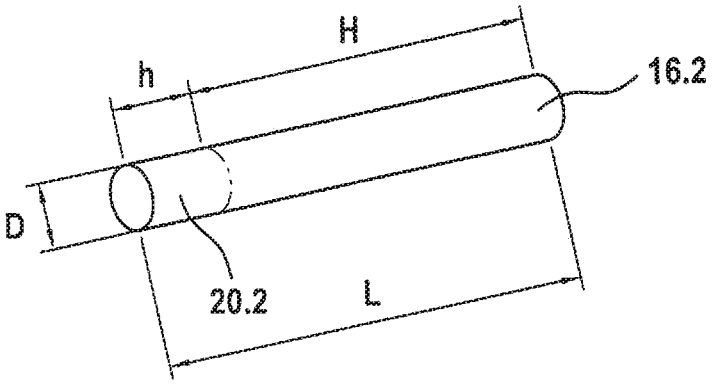

One of the pin-shaped heat dissipating elements 16.2 is shown by itself in FIG. 2*b*. The heat dissipating element 16.2 is essentially cylindrical and has a length L and a diameter D. The length L is in part formed of the connecting section 20.2, which is similar to the one in FIGS. 1*a* and 1*b*, and has the length h that corresponds to the depth of one of the respective sockets 18.2 in the base body 10. The remaining part of the pin-shaped heat dissipating element 16.2 has the length H that protrudes from the base body 10.2 when the heat dissipating element 16.2 has been inserted into the base body 10.2; in other words, L equals (h+H) in this case.

Figure 3A:
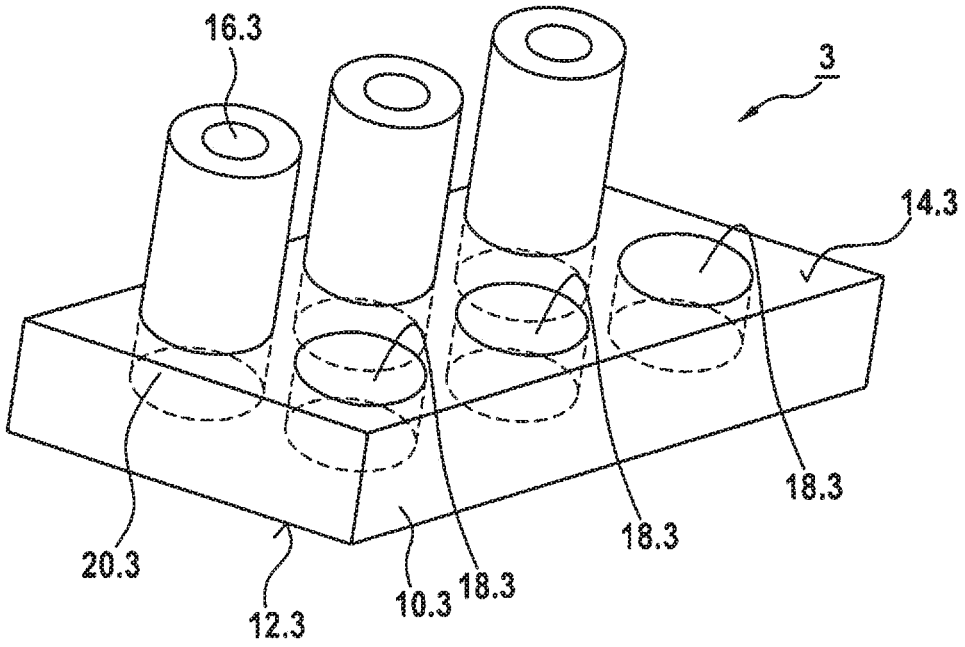
FIGS. 3*a* and 3*b* show a third exemplary embodiment of a heat sink.
Figure 3B:
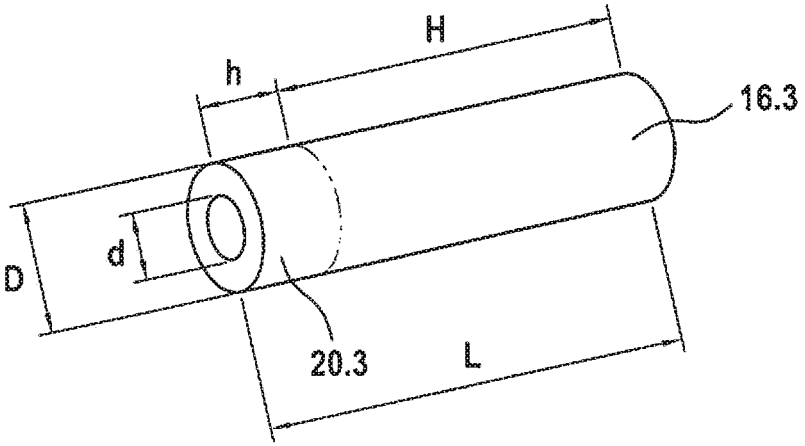

FIG. 3*a* shows the third exemplary embodiment of the heat sink 3. In this case (as in the first and second exemplary embodiment), the heat dissipating surface 14.3 of the base body 10.3 has sockets 18.3 formed in it, into which the tubular heat dissipating elements 16.3 are inserted and fastened. The tubular heat dissipating elements 16.3 are once again composed of an electrically insulating material having a thermal conductivity on the same order of magnitude as that of the metal of the base body 10.3. The tubular heat dissipating elements 16.3 in the exemplary embodiment are in the form of a hollow cylinder with an outer diameter D, an inner diameter d, and a length L. The length of the heat dissipating element 16.3 is divided into the connecting section 20.3 with a length h, which sections are inserted to a depth h into the correspondingly formed sockets 18.3 of the base body 10.3. The remaining section of the heat dissipating element 16.3 that protrudes from the base body 10.3 when the heat dissipating element 16.3 has been inserted into the base body 10.3, has the length H; in other words, here—as in FIGS. 2*a* and 2*b*—L equals (h+H).

As mentioned above, in the heat sinks 1, 2, and 3 described in conjunction with FIGS. 1*a* to 3*b*, the base body 10.1, 10.2, 10.3 is made out of a metal with a high thermal conductivity, preferably with a thermal conductivity coefficient of 100 W/(m K) or more. For the exemplary embodiments, aluminum with a thermal conductivity coefficient of approx. 240 W/(m K) or copper with a thermal conductivity coefficient of approx. 400 W/(m K) is used. Naturally, the base body 10.1, 10.2, 10.3 can also be composed of another metal or metal alloy.

The heat dissipating elements 16.1, 16.2, and 16.3 are composed of a ceramic that has a thermal conductivity coefficient on the same order of magnitude as that of the metal of the base body 10.1, 10.2, 10.3. Preferably, the ceramic thus likewise has a thermal conductivity coefficient of greater than 100 W/(m K). For the exemplary embodiments, aluminum nitride with a thermal conductivity coefficient of approx. 180 to 220 W/(m K) or silicon carbide with a thermal conductivity coefficient of approx. 350 W/(m K) was used.

As is clear from FIGS. 1*a*, 2*a*, and 3*a*, the heat dissipating elements 16.1, 16.2, and 16.3 are each inserted into corresponding sockets 18.1, 18.2, and 18.3 that have been produced in the base body 10.1, 10.2, 10.3. Various joining techniques can be used to ensure a sufficient fastening of the heat dissipating elements 16.1, 16.2, and 16.3 that has a particularly good thermal conductivity.

For example, in the exemplary embodiments shown in FIGS. 1*a* and 2*a*, the respective heat dissipating element 16.1 or 16.2 can be joined to the base body 10.1, 10.2 with form-fitting engagement and/or with frictional, nonpositive engagement in that the respective connecting section 20.1, 20.2 is fastened in the associated socket 18.1, 18.2 by means of a press fit or by means of clamping. In order to insert the heat dissipating elements into the corresponding sockets in the base body 10.1, 10.2, it is possible, for example, to correspondingly heat the base body 10.1, 10.2 so that the base body 10.1, 10.2 expands. In this state, the ceramic heat dissipating elements 16.1, 16.2 can be inserted into the respective sockets 18.1, 18.2. Once the base body 10.1, 10.2 has cooled again, the heat dissipating elements 16.1, 16.2 are firmly attached to the base body 10.1, 10.2. In this case, it is only necessary to make sure that the dimensions of the recesses 18.1, 18.2 are sized so that the heat dissipating elements 16.1, 16.2 cannot come loose due to the expansion of the metal of the base body 10.1, 10.2 at the temperatures that are achieved during proper operation.

An alternative fastening variant is possible in the exemplary embodiments of FIGS. 2*a* and 3*a*. To this end, a first thread can be machined or molded into the heat dissipating elements 16.2, 16.3, at least in the region of the respective connecting section 20.2, 20.3 (not shown). Then corresponding second threads can be machined into the corresponding sockets 18.2, 18.3 in the base body 10.2, 10.3, which in this case are then embodied in the form of holes. Correspondingly, the heat dissipating elements 16.2, 16.3 can be connected to the base body 10.2, 10.3 in that the connecting sections 20.2, 20.3 are each fastened in the respective socket 18.2, 18.3 by means of being screwed into it. If the base body 10.2, 10.3 heats up and thus expands during operation of the heat sink, the ceramic heat dissipating elements 16.2, 16.3 are only subjected to compressive strain, which additionally reduces the heat transfer resistance between the base body and the heat dissipating elements.

In other embodiments, the heat dissipating elements 16.1, 16.2, or 16.3 of the exemplary embodiments in FIGS. 1*a* to 3*a* are fastened in the respective base body 10.1, 10.2, 10.3 by being cast in place. In this case, the sockets 18.1, 18.2, 18.3 that are machined into the base body 10.1, 10.2, 10.3 and/or the dimensions of the respective connecting section 20.1, 20.2, 20.3 are sized so that between the base body 10.1, 10.2, 10.3 and the heat dissipating element 16.1, 16.2, 16.3, an interstice is formed after the insertion. This interstice between each connecting section 20.1, 20.2, 20.3 and the respective socket 18.1, 18.2, 18.3 can be filled in or filled up with a very thermally conductive casting compound that solidifies and can harden.

After the casting compound solidifies or hardens, the respective heat dissipating element is firmly connected to the base body 10.1, 10.2, 10.3.

Another alternative for fastening the heat dissipating elements 16.1, 16.2, 16.3 in the respective sockets 18.1, 18.2, 18.3 provided in the base bodies 10.1, 10.2, 10.3 can be achieved by means of gluing or sticking them in place with a suitable adhesive.

Another option for producing a connection between the heat dissipating elements 16.1, 16.2, 16.3 in the sockets 18.1, 18.2, 18.3 machined into the respective base body 10.1, 10.2, 10.3 is soldering. To that end, after being inserted into the corresponding socket 18.1, 18.2, 18.3 in the base body 10.1, 10.2, 10.3, the respective heat dissipating element 16.1, 16.2, 16.3 is soldered to the base body 10.1, 10.2, 10.3 in an intrinsically known way with a suitable solder.

In a modification, in order to achieve a better wetting of the heat dissipating element 16.1, 16.2, 16.3 composed of ceramic with solder, this element is previously metallized in the region of the connecting section 20.1, 20.2, 20.3.

Figure 4A:
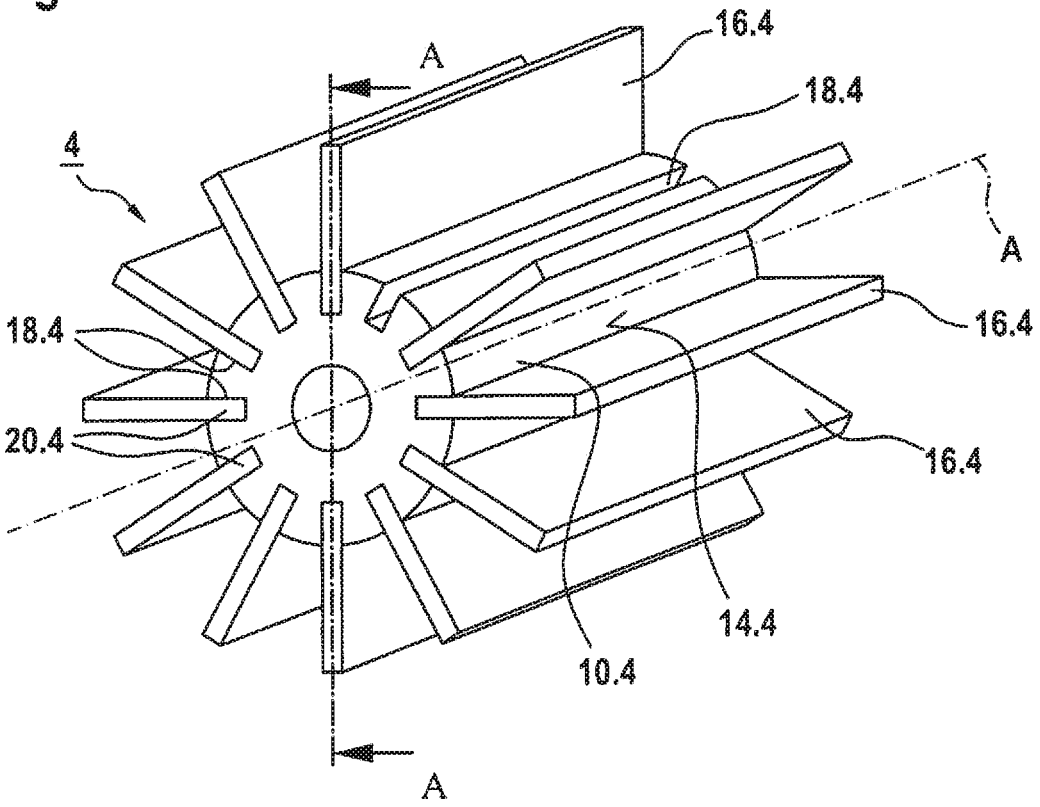
FIG. 4*a* shows a fourth exemplary embodiment of a heat sink with a cylindrical base body made of metal and cooling fins made of ceramic.

FIG. 4*a* shows a fourth exemplary embodiment of a heat sink 4. Basically, that which has been stated about the exemplary embodiments in FIGS. 1*a* to 3*b* also applies correspondingly to the fourth exemplary embodiment.

The base body 10.4 of the fourth exemplary embodiment is rotationally symmetrical in comparison to the base bodies 10.1, 10.2, 10.3. The base body 10.4 can be produced as a turned element or produced by means of a CNC machine.

The base body 10.4 has an inner surface 12.4 of a recess 22 extending axially in the base body 10.4. The inner surface 12.4 is once again used for coupling to a heat source from which heat is to be dissipated by means of the heat sink.

The outer surface 14.4 of the base body 10.4 is part of the heat dissipating surface into which the sockets 18.4 for the heat dissipating elements 16.4 are machined. The sockets 18.4 are machined into the base body 10.4, for example by means of milling, in the form of axially extending slots.

Plate-shaped ceramic elements functioning as the heat dissipating elements 16.4 are inserted into the axially extending slots in order to enlarge the effective heat dissipating surface area. The heat dissipating elements 16.4 are spaced apart from one another uniformly and in a star-pattern around the circumference of the base body 10.4. A uniform enlargement of the effective heat dissipating surface area is thus achieved across the entire circumference region of the base body 10.4.

Figure 4B:
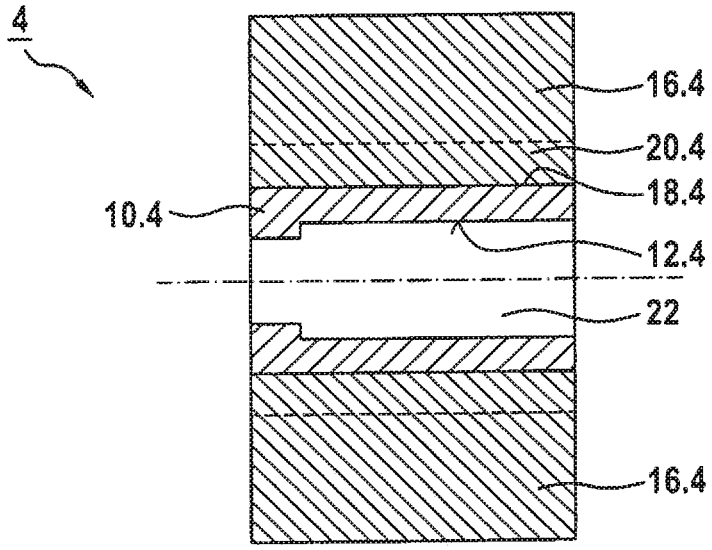
FIG. 4*b* shows the cross-section AA of FIG. 4*a*.
Figure 5A:
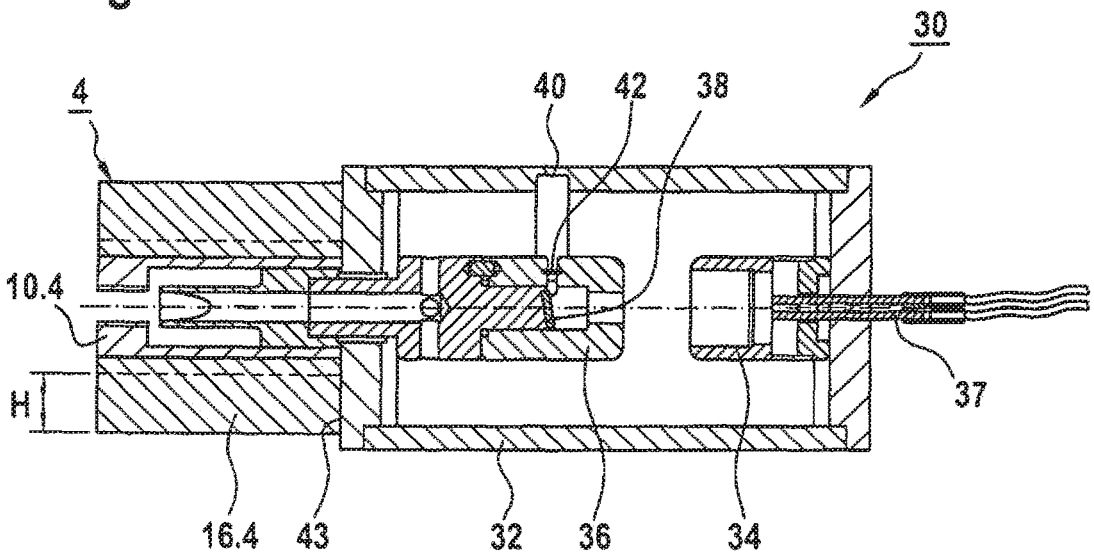
FIG. 5*a* shows a cross-section of an X-ray tube with the heat sink from FIGS. 4*a* and 4*b* functioning as an anode heat sink.

The heat sink 4 shown in FIGS. 4*a* and 4*b* can be used, for example, as a heat sink for an anode of an X-ray tube used as an X-ray radiation generator. FIG. 5*a* shows a cross-section through an example of an X-ray tube 30, which has an anode 36 as a component that conducts a high voltage and heats up during operation. In order to cool the anode 36 during the operation of the X-ray tube 30, the heat sink 4 that is shown in FIGS. 4*a* and 4*b*, is fastened in a thermally conductive way to the part of the anode 36 leading out of the X-ray tube 30. In order to dissipate the heat from the heat sink, the X-ray tube is positioned in a tank (not shown) that is filled with oil acting as the insulating medium. The high heat capacity of oil makes it possible to transport heat away from the heat sink by means of the oil through the use of a heat exchanger. Basically, air could also be used as an insulating medium. Air does not have as good cooling properties, though.

The X-ray tube 30 essentially has an evacuated cylindrical housing 32, which is likewise composed of a ceramic. Firstly, the housing 32 contains a heated cathode 34, which can be contacted from the outside by means of corresponding lines 37 via corresponding through openings in the housing 32. Situated opposite from the cathode 34 is the anode 36, which during the operation of the X-ray tube 30, is acted on with a corresponding high voltage in order to accelerate the electrons emitted by the cathode 34. On the anode 36, there is a target 38, for example composed of tungsten, which is customarily provided in order to produce X-ray radiation. X-rays, which are generated by the electrons that penetrate into the target 38 and are decelerated by it, exit the X-ray tube 30 by means of a radiation window 40 in the housing 32. A titanium foil 42 can be positioned in the optical path for beam hardening of the X-ray radiation.

The connecting end of the cathode 34 leads out from the end 43 of the housing 32. At this location, the heat sink 4 is connected to the anode 36 in a way that provides good thermal conduction in order to dissipate the heat that is generated during operation.

Figure 5B:
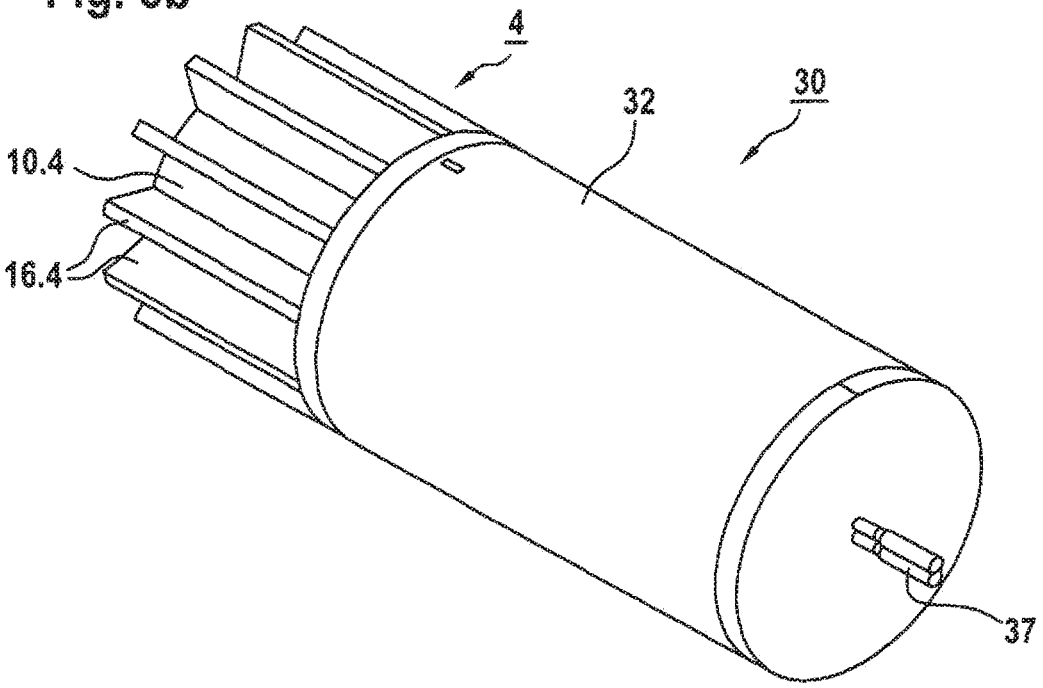
FIG. 5*b* is a perspective view of the X-ray tube of FIG. 5*a*.

FIG. 5*b* provides a supplementary perspective view of the X-ray tube 30 from FIG. 5*a* for the sake of better illustration.

The invention claimed is:

1. An X-ray tube for conducting a high voltage, comprising:

an anode configured to conduct a high voltage and heat up during operation;

a heat sink connected in a thermally conductive way to the anode and configured for cooling the anode, the heat sink including:

a base body composed of a metal, the base body including a heat absorbing surface for coupling to the anode as a heat source and a heat dissipating surface;

one or more heat dissipating elements that are connected to the base body, the one or more heat dissipating elements being composed of an electrically insulating material having a thermal conductivity on the same order of magnitude as that of the metal of the base body, and wherein the heat dissipating elements have a height starting from the base body of the heat sink so that taking into account the high voltage and an insulating medium surrounding the heat dissipating elements, there is a sufficient insulation breakdown resistance relative to the surroundings of the X-ray tube.

2. The X-ray tube according to claim 1, wherein the base body is composed of a metal having a thermal conductivity coefficient that is greater than 100 W/(m K).

3. The X-ray tube according to claim 1, wherein the one or more heat dissipating elements are composed of a ceramic having a thermal conductivity coefficient that is greater than 100 W/(m K).

4. The X-ray tube according to claim 1, wherein the one or more heat dissipating elements are at least one of plate-shaped, pin-shaped, or tubular.

5. The X-ray tube (30) according to claim 1, wherein for each of the one or more heat dissipating elements, the base body has a corresponding socket dimensioned to accommodate a connecting section of each of the one or more heat dissipating elements.

6. The X-ray tube according to claim 5, wherein the one or more heat dissipating elements are connected to the base body in that the respective connecting section is fastened in the corresponding socket by at least one of a press fit or clamping.

7. The X-ray tube according to claim 5, wherein the one or more heat dissipating elements are at least one of pin-shaped or tubular at least in the region of the connecting section and have a first thread in the connecting section, and wherein the sockets in the base body comprise holes having corresponding second threads for fastening with the connecting section of the one or more heat dissipating elements by a screw connection.

8. The X-ray tube according to claim 5, wherein the one or more heat dissipating elements are attached to the base body by being cast in place, and an interstice between the respective connecting section and the socket is filled with a casting compound.

9. The X-ray tube claim 1, wherein the one or more heat dissipating elements are attached to the base body by at least one of an organic adhesive or an inorganic adhesive.

10. The X-ray tube according to claim 5, wherein the one or more heat dissipating elements at least the connecting section of each of the one or more heat dissipating element is metalized, and the one or more heating dissipating elements are attached to the base body by soldering.

11. The X-ray tube according to claim 1, wherein the base body further includes a turned element with an inner surface of an axially extending recess that is adapted for coupling to the anode as the heat source, and an outer surface of the heat dissipating surface that includes one or more sockets wherein each of the one or more heat dissipating elements is inserted into a corresponding each of the one or more sockets.

12. The X-ray tube according to claim 11, wherein the one or more sockets comprise axially extending slots or grooves for receiving the one or more heat dissipating elements.

13. The X-ray tube according to claim 1, wherein the base body is composed of at least one of aluminum, copper, silver, or a metal alloy.

14. The X-ray tube according to claim 1, wherein the base body is composed of a metal having a thermal conductivity coefficient in the range of 100 to 450 W/(m K).

15. The X-ray tube according to claim 1, wherein the anode is configured to conduct a voltage greater than 120 kV.

16. The X-ray tube according to claim 1, wherein the anode is configured to conduct a voltage greater than 200 kV.

17. The X-ray tube according to claim 1, wherein the one or more heat dissipating elements are composed of at least one of silicon carbide or aluminum nitrate.

18. The X-ray tube according to claim 1, wherein the one or more heat dissipating elements are composed of a ceramic having a conductivity coefficient in the range of 100 to 350 W/(m K).

19. The X-ray tube according to claim 12, wherein the one or more heat dissipating elements comprise plate-shaped ceramic elements.

* * * * *